United States Patent [19]

Dastoli et al.

[11] 4,355,641

[45] Oct. 26, 1982

[54] NURSING BRA

[76] Inventors: Barbara Dastoli, 45 Brenton Ter., Pittsfield, Mass. 01201; Brigitte Garner; Ellen Gorski, both of The Hancock Inn, Hancock, Mass. 01237

[21] Appl. No.: 182,967

[22] Filed: Sep. 2, 1980

[51] Int. Cl.[3] ..... A41C 3/04

[52] U.S. Cl. ..... 128/460; 128/510

[58] Field of Search ..... 128/460, 510, 509, 477, 128/443

[56] References Cited

U.S. PATENT DOCUMENTS

| | | | |
|---|---|---|---|
| 2,343,607 | 3/1944 | Wrigley | 128/510 |
| 3,075,530 | 1/1963 | Smith | 128/477 |

FOREIGN PATENT DOCUMENTS

| | | | |
|---|---|---|---|
| 1255216 | 1/1961 | France | 128/510 |
| 208288 | 9/1923 | United Kingdom | 128/490 |

*Primary Examiner*—Doris L. Troutman

[57] ABSTRACT

A nursing bra provides both flex and support to a nursing mother and provides ready access to the breasts for infant feeding. In one embodiment, the support is provided by a relatively non-elastic cup member supported by a pair of straps. The top strap is fabricated from a material that stretches more readily than the lower strap. Another embodiment comprises a multifunctional cup comprising a top and bottom section. The top section is made of a flexible and absorptive material which can be conveniently lowered to expose the breast whereas the bottom portion is comprised of a relatively non-flexible support material.

18 Claims, 6 Drawing Figures

NURSING BRA

BACKGROUND OF THE INVENTION

Nursing bras, as currently available, are rather unstylish and cumbersome in view of today's modern feminine apparel styles. Most of the usual forms of nursing bras contain some means for unhooking and folding down the cups to expose the nipple for access.

Over the past ten years or so, there has been a return to nursing on the part of health-conscious mothers. Women today are nursing their infants over longer periods of time, sometimes up to four years after birth. Because of the cumbersome and unstylish designs of the nursing bras now in existence, women are reluctant to use nursing bras and opt for more stylish bras for appearance and support. In order to provide access to the breasts, the bras have to be removed while the woman is nursing. This involves going into a private room or to a public rest room when the mother is away from home and the child has to be fed.

The purpose of this invention is to provide a nursing bra which is both stylish and supportive and further, provides ready access to the mother's nipples without the necessity of removing the bra completely.

SUMMARY OF THE INVENTION

The invention comprises a nursing bra having cups made of a material that has the combined features of flex and support. In order to provide further support, a pair of suspending straps are provided wherein the top strap has a high degree of flexibility relative to the lower support strap. In another embodiment, the cup itself is made of a lower material having good support qualities and very little flex, wherein the top portion provides some support but a good deal of flex. In both embodiments, the top portion is pulled down to expose the nipple during the nursing period.

DESCRIPTION OF THE PREFERRED EMBODIMENT

Figure 1:
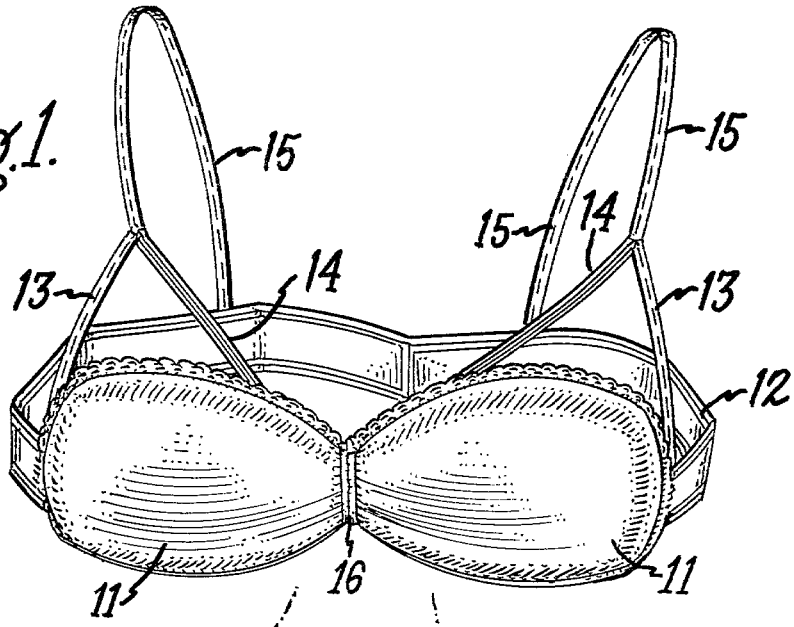
FIG. 1 is a front view of a nursing bra according to the invention.

FIG. 1 contains a nursing bra 10 having a pair of support cups 11, a support band 12, lower strap 13, upper strap 14, both attached to a support strap 15. A connecting portion 16 extends between both cups 11 in a manner similar to most non-nursing-type bras. In order to support the breasts and yet still maintain a sufficient degree of flex, cup 11 is manufactured from a spandex material which is a generic name for stretch fibres based on synthetic, elastomeric, long-chain polymers. Lower strap 13 is manufactured from a material having less flex than the material used for cups 11 and maintains its support, particularly when the top portion of cup 11 is folded down to expose the nipple during nursing. Upper strap 14 is made from a flexible material, such as spandex, and allows the top portion of cup 11 to be pulled down while lower strap 13 in combination with support strap 15 and band 12 is adequate support to the other breast as well as the bottom portion of the breast that is exposed for nursing.

Figure 2:
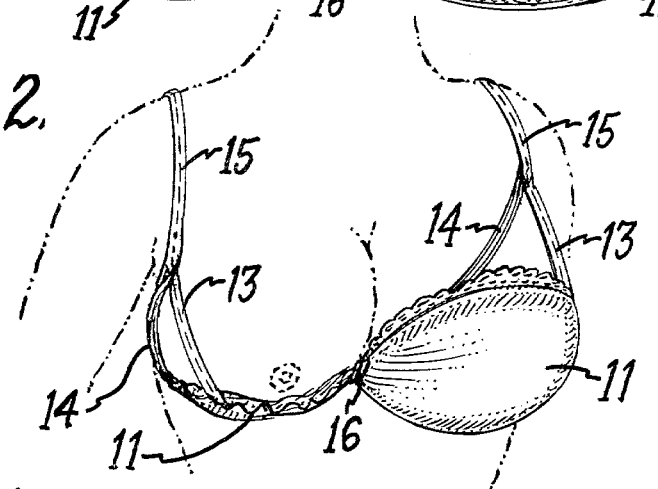
FIG. 2 is a front perspective view of the nursing bra shown in FIG. 1 with one of the cups lowered to expose the nipple.

FIG. 2 shows bra 10 supporting one breast by means of upper and lower straps 14, 13, support strap 15, band 12, and center portion 16 relatively unstressed, whereas the cup 11 which has its top portion bent down to expose the mother's nipple retains lower strap 13, band 12 both in a supportive position, with upper strap 14 bent down under the mother's breast and is extended in combination with the upper portion of cup 11. Upon completion of her nursing activity, the nursing mother can bring the top portion of folded cup 11 back into a supportive position by lifting the top portion of cup 11 over the exposed nipple and sliding upper strap 14 back over her breast.

Figure 3:
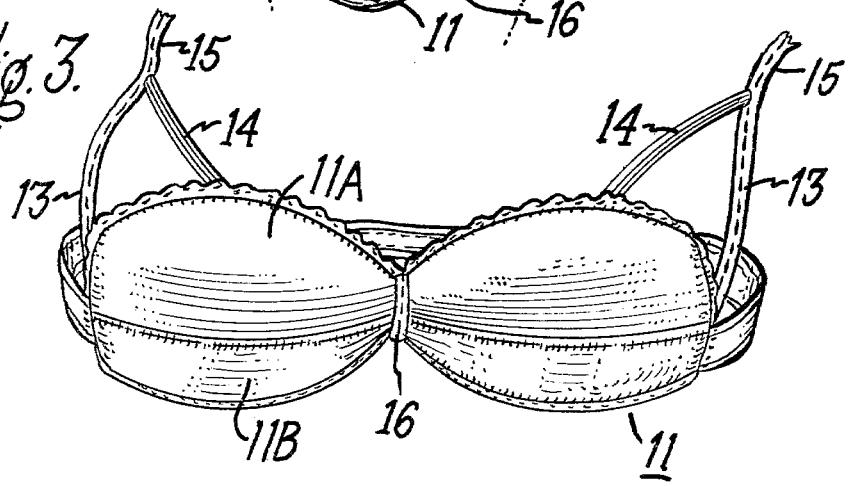
FIG. 3 is a front view of an alternate embodiment of the nursing bra according to the invention.

FIG. 3 shows another embodiment 10 wherein upper strap 14, lower strap 13, support strap 15, and band 12 are similar to the embodiment depicted in FIGS. 1 and 2, with cup 11 divided into an upper portion 11A and a lower portion 11B. Upper portion 11A is made from a similar flex material as upper strap 14 and connective portion 16, whereas bottom portion 11B is made of a supportive material similar to lower strap 13. This allows upper portion 11A to be slipped down to expose the nipple because of flexible properties of upper portion 11A and upper strap 14. Bottom portion 11B, band 12, lower strap 13, and support strap 15 help to retain the other breast in its natural position as well as the support the bottom portion of the breast that is used during nursing. The material comprising 11A can be spandex or a similar elastic material, whereas the material comprising lower portion 11B as well as lower strap 13, can comprise nylon, cotton, or any similar supportive material with relatively low flex.

Figure 4:
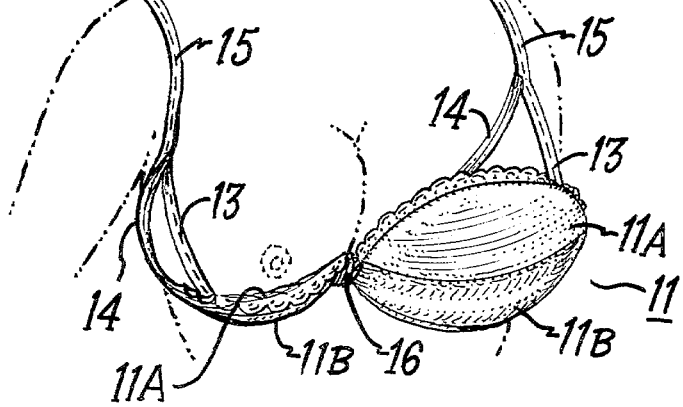
FIG. 4 is a front perspective view of the nursing bra shown in FIG. 3 with one of the cups lowered to expose the nipple.

FIG. 4 shows the embodiment depicted in FIG. 3 with one top portion 11A dropped down away from the breast to expose the nursing nipple and with upper strap 14 down under the mother's breast, with lower strap 13 and bottom portion 11B remaining in place to give adequate support to the bottom portion of the exposed breast.

An important feature of the nursing bra of the instant invention is the flexibility and absorptivity of the material used to form at least the upper portion 11A of cups 11 and the non-flexibility of lower straps 13, support strap 15, and band 12. Upper and lower straps 14, 13 can comprise a single wide strap wherein the top portion comprises a strip of flexible material and the bottom portion comprises a strip of relatively non-flexible material similar to bottom cup 11B shown in FIGS. 3 and 4.

Figure 5:
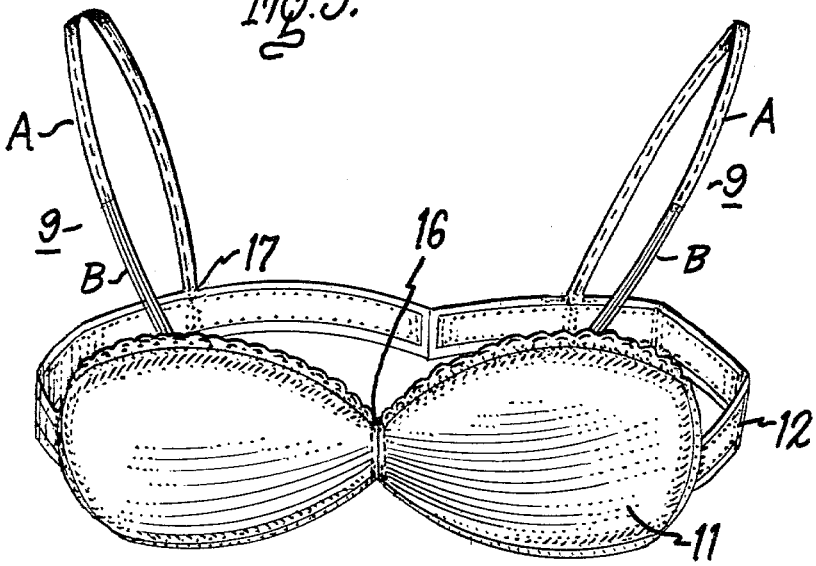
FIG. 5 is a front perspective view of a two-part strap embodiment of the nursing bra of the invention.
Figure 6:
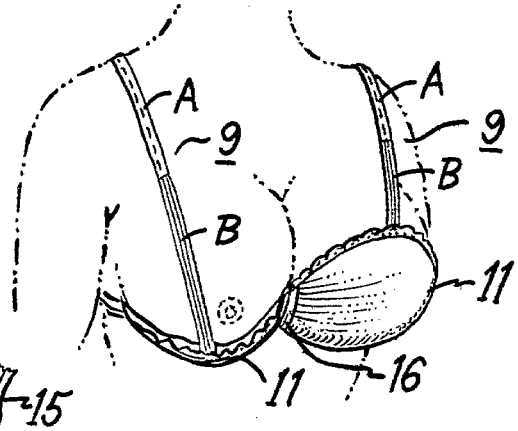
FIG. 6 is a front perspective view of the embodiment of FIG. 5 with one of the cups lowered to expose the nipple.

FIG. 5 contains a nursing bra 10 of the type similar to that depicted in FIG. 1 wherein cup 11 comprises a material of flex and support, such as spandex. Lower part B of strap 9 in this embodiment is made from a similar material having both flex and support, but more flex and less support than upper part A. Band 12 is formed from a material having good supportive properties and connective portion 16 is made from a material similar to that of cups 11 and lower part B. Lower part B of strap 9 contacts and is attached to band 12 at 17 in a direct configuration as shown rather than to a support strap 15 as shown in FIGS. 1–4. This allows lower part B to be moved downward with cup 11 as shown in FIG. 6. Upper part A remains on the shoulder while lower part B becomes stretched along with the lower portion of cup 11 which is pulled down and under the breast. When the "two-part" strap configuration is used with the nursing bras 10 shown in FIGS. 3 and 4, and having an upper cup portion 11A and lower cup portion 11B, upper part A is attached to lower cup portion 11B and lower part B is attached to upper cup portion 11A. This allows upper cup portion 11A to be slipped down under the exposed breast while upper strap part A remains on the shoulder as shown in FIG. 6.

What is claimed as new and which it is desired to secure by Letters Patent of the United States is:

1. A nursing bra comprising:

A pair of support cups;

An upper strap and a lower strap attached to said cups for providing support to said cups;

A support band connecting said cups and adapted to be disposed along the back of the person wearing said bra, said upper strap being composed of a flexible material and said bottom strap being composed of a non-flexible material.

2. The nursing bra of claim 1 wherein said cups are composed of a flexible material for providing access to the nipple of a person by allowing said person to stretch a top portion of said cups down over the breast of the wearer to expose said nipple for nursing convenience.

3. The nursing bra of claim 1 further including a connective member between said two cups.

4. The nursing bra of claim 1 wherein said support band is made of a non-flexible material.

5. The nursing bra of claim 1 wherein said upper strap and said lower strap are connected to an upper portion of one of said cups and a lower portion of said one cup at one end and to a support strap at an opposite end thereof, said support strap being of a non-flexible material.

6. The nursing bra of claim 1 wherein each of said cups comprises a top and bottom component structure and wherein said top component is flexible and said bottom component is non-flexible for allowing said top portion to be pulled over the breast of the wearer to expose the wearer's nipple and wherein the bottom portion supports the wearer's breast.

7. The nursing bra of claim 6 wherein said top strap is composed of a similar flexible material as the top portion of each of said cups.

8. The nursing bra of claim 6 wherein said bottom strap is composed of a similar material to said bottom portion of each of said cups.

9. The nursing bra of claim 6 wherein said connecting member is made of a material similar to said top portion of each of said cups.

10. The nursing bra of claim 1 wherein said cups and said upper straps are composed of a material selected from the group consisting of spandex fibre or elastic fibre and wherein said lower strap and support band are composed of a material selected from the group consisting of cotton or nylon.

11. The nursing bra of claim 6 wherein said top portion of each of said cups is composed of a spandex or elastic fibre and said bottom portion of each of said cups is composed of a material selected from the group consisting of cotton or nylon.

12. A nursng bra comprising:

A pair of support cups connected together;

A support band connecting said cups and adapted to be disposed along the back of the person wearing said bra;

A support strap connecting between an upper support strap, a lower support strap and said support band, said upper strap composed of a flexible material connecting between an upper portion of each of said cups and said support strap, and adapted to be stretched beneath the breast of a nursing mother;

A lower strap composed of a support material having less flex than said upper strap and connecting between a side portion of each of said cups and said support straps, and adapted to support the breast of a nursing mother.

13. The nursing bra of claim 12 wherein said upper portion of said support cups is composed of a material having greater flex than a lower portion, said upper support strap is composed of the same material as said upper cup portion, said lower strap being composed of the same material as said lower cup portion for providing movement of said upper strap and said upper cup portion while retaining said lower strap and said lower cup portion.

14. A nursing bra comprising:

A pair of support cups connected together;

A support band connecting said cups and adapted to be disposed along the back of the wearer;

A support strap extending between said support band and a top portion of each of said cups, said support strap having an upper part and a lower part, said upper part and a lower part, said upper part being attached to said support band and said lower part being attached to said top portion.

15. The nursing bra of claim 14 wherein said support cups are composed of a material having both flex and support and are adapted to be slipped down under the breast of the wearer.

16. The nursing bra of claim 15 wherein said upper part is composed of a material having more support than said lower part.

17. The nursing bra of claim 15 wherein said lower part is composed of a material having more support than said upper part.

18. The nursing bra of claim 14 wherein said cups are composed of an upper part and a lower part, said upper part of said cups having more flex than said lower part of said cups.

* * * * *